US008782854B1

(12) United States Patent
Samuels

(10) Patent No.: US 8,782,854 B1
(45) Date of Patent: Jul. 22, 2014

(54) UNIVERSAL HANDLE DEVICE

(71) Applicant: North Coast Medical, Inc., Gilroy, CA (US)

(72) Inventor: Stephen Samuels, San Jose, CA (US)

(73) Assignee: North Coast Medical, Inc, Gilroy, CA (US)

( * ) Notice: Subject to any disclaimer, the term of this patent is extended or adjusted under 35 U.S.C. 154(b) by 0 days.

(21) Appl. No.: 14/067,046

(22) Filed: Oct. 30, 2013

(51) Int. Cl.
*E05B 1/00* (2006.01)

(52) U.S. Cl.
USPC ..... 16/428; 24/115 R; 482/126; 482/139

(58) Field of Classification Search
USPC ..... 16/110.1, 421, 422, 428, 430, 431, 444, 16/445; 24/115 R, 115 H; 482/126, 129, 482/139, 122
See application file for complete search history.

(56) References Cited

U.S. PATENT DOCUMENTS

| | | | | | |
|---|---|---|---|---|---|
| 1,965,511 | A * | 7/1934 | Preston | 482/129 |
| 3,528,656 | A * | 9/1970 | Haanen | 482/139 |
| 4,257,592 | A * | 3/1981 | Jones | 482/131 |
| 4,762,318 | A * | 8/1988 | Phillips et al. | 482/126 |
| 5,533,952 | A * | 7/1996 | Schaber | 482/70 |
| 5,885,196 | A * | 3/1999 | Gvoich | 482/125 |
| 6,151,758 | A * | 11/2000 | Chiu | 16/443 |
| 6,692,415 | B1 * | 2/2004 | Winston | 482/126 |
| 7,316,636 | B1 * | 1/2008 | Hinds et al. | 482/126 |
| 7,473,213 | B1 * | 1/2009 | Kallenbach | 482/139 |
| 2013/0288864 | A1 * | 10/2013 | Holland | 482/126 |

* cited by examiner

*Primary Examiner* — William Miller
(74) *Attorney, Agent, or Firm* — Bay Area Technology Law Group, PC

(57) ABSTRACT

A device for releasably retaining a cord or flexible tube. The device includes a U-shaped yoke and a rotatable handle sized for gripping by the hand of a user. The cord or flexible tube is releasably received by a capture cap and can emanate directly therefrom or be routed to a loop located at the end of the handle in order to alter its orientation.

8 Claims, 2 Drawing Sheets

UNIVERSAL HANDLE DEVICE

TECHNICAL FIELD OF INVENTION

The present invention involves a universal handle device for gripping various sizes of cords, tubes, or cloth, and in particular, stretchable cords and tubes which have been traditionally employed as expedients for exercise and rehabilitation. The present device not only creates a releasable but secured attachment to such cords, tubes, or cloth but also is configured to direct them either perpendicular or parallel to the handle This enables the user to enjoy multiple orientations during exercise and physical therapy.

BACKGROUND OF THE INVENTION

Those involved in resistive training, exercise and rehabilitation have long appreciated the benefits of resistive cords and bands. Not only are such appliances inexpensive, but they occupy little space and can be used for an almost limitless array of resistive movements. In addition, resistive cords and bands are available in varying resistances which are often color coded to enable a user to progress from one resistance to the next depending upon the muscle group being challenged and the progress one makes as the benefits of repetitive exercise are realized.

In addition to the above, those involved in physical therapy suggest the use of resistive cords and bands as they have little or no impact on the user's joints thus minimizing the pain that a patient might feel when using them. Those who are obese and the elderly can particularly benefit from their use.

In addition, those who have experienced tendon damage and have undergone surgical procedures can experience atrophy and limited range of joint motion requiring a slow but methodical rehabilitation regiment usually under the care of a skilled physical therapist. Stretchable cords and bands and even ropes and cloth strips are ideally suited for such rehabilitation as their resistance and implementation can be tailored to a specific joint and muscle group requiring rehabilitative therapy.

Whenever stretchable bands and cords and even non-flexible rope or cloth are employed, they must be gripped or otherwise attached to the appendage of a user. The use of stirrups and handles are most common noting that one end of cord, band or rope can be attached to a fixed abutment such as a hook or door handle while the other grasped in order to carry out the exercise movement.

Traditionally, handles are fixed to specific bands or cords such that as the user decides to change resistance, a new cord having its own handle must be used. This results in needless costs as, generally, the handles appended to various resistive cords or bands are identical to one another. Significant savings would be appreciated if a handle or stirrup could be changed from one band to the next as needed.

In addition to the above, it has been recognized that, depending upon the exercise motion being employed, the orientation of the handle or stirrup with respect to the longitunal axis of the cord or band ideally should vary order to achieve maximum exercise or rehabilitative benefit. As virtually no handles or stirrups enable the user to change their orientation with respect to the resistive cord or band to which they are attached, the use of such products are compromised thus reducing the maximum benefit one might otherwise achieve.

Thus an object of the present invention is to provide a universal handle device which is capable of changing its orientation with respect to the cord, band, rope, or cloth to which it is appended simply and conveniently thus maximizing the exercise and rehabilitative potential inherent in such devices.

Yet a further object of the present invention is to provide a device in which a cord, band, rope or cloth can be selectively detached from its handle to free the handle to be attached to other such cords, bands, ropes or cloth.

These and further object be more readily apparent when considering the following disclosure and appended claims.

SUMMARY OF INVENTION

A device for releasably retaining a cord of flexible tube, such device comprising a U-shaped yoke having terminal ends and a mid-point therebetween, an opening located proximate each of said terminal ends and a handle sized for gripping by the hand of a user, said handle having first and second ends, each of said first and second ends being sized for receipt by openings proximate each of said terminal ends of said U-shaped yoke and being rotatable therein, said handle further comprising a loop extending from one end thereof and sized to extend outside of said U-shaped yoke when said handle first and second ends are received by said openings, a capture cap having a capstan with a helical track supported at said mid-point of said U-shaped yoke, said capture cap having a cap opening for receipt of said cord or flexible tube and a circumferential edge for a abutting said yoke, said helical track being sized and positioned to receive said cord or flexible tube from said cap opening, said cord or flexible tube being lockably retained on said helical track upon rotation of said capture cap in a first direction and removable from said helical track upon rotation of said capture cap in a second direction.

DETAILED DESCRIPTION OF THE INVENTION

Figure 1:
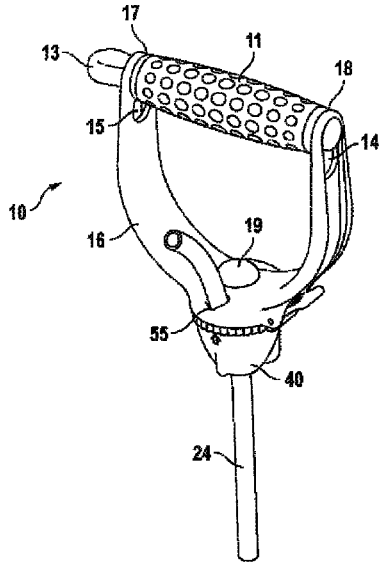
FIG. 1 is a perspective view of the universal handle device of the present invention together with a cord or flexible tube retained therein.

Novel features which are characteristic of the invention, as to organization and method of operation, together with further objects and advantages thereof will be better understood from the following description considered in connection with the accompanying drawings, in which preferred embodiments of the invention are illustrated by way of example. It is to be expressly understood, however, that the drawings are for illustration description only and are not intended as definitions of the limits of the invention. The various features of novelty which characterize the invention are recited with particularity in the claims.

There has been broadly outlined more important features of the invention in the summary above and in order that the detailed description which follows may be better understood, and in order that the present contribution to the art may be appreciated. There are, of course, additional features of the invention that will be described hereinafter and which will form additional subject matter of the claims appended hereto. Those skilled in the art will appreciate that the conception upon which this disclosure is based readily may be utilized as a basis for the designing of the other structures, methods and systems for carrying out the several purposes of the present invention. It is important therefore, that claims be regarded as including such equivalent constructions insofar as they do not depart from the spirit and scope of the present invention.

Certain terminology and the derivations thereof may be used in the following description for convenience and reference only, and will not be limiting. For example, words such as "upward," "downward," "left," and "right" refer to directions in the drawings to which reference is made unless otherwise stated. Similar words such as "inward" and "outward" refer to directions toward and away from, respectively, the geometric center of a device or area and designated parts thereof. Reference in the singular tense include the plural and vice versa, unless otherwise noted.

In turning to FIG. 1, device 10 is depicted for releasably retaining cord or flexible tube 24. It is noted that throughout this disclosure, element 24 is described as a cord or flexible tube although it should be understood that element 24 can also include rope, woven or unwoven cloth and other linear segments which will not be specifically referred to for the sake of expediency.

Turning once again to FIG. 1, device 10 further includes U-shaped yoke 16 having terminal ends 17 and 18 and mid-point 19 therebetween.

Openings 14 and 15 are positioned proximate terminal ends 17 and 18. Handle 11 is sized for gripping by the hand of the user, handle 11 having first and second ends 12 and 13 being sized for receipt by openings 14 and 15 knowing that openings 14 and 15 are ideally in the form of eyelets having an expanded portion for receiving handle 11 which, when slid towards terminal ends 17 and 18, would be rotatably captured thereby thus preventing handle 11 from inadvertently being released by yoke 16.

Figure 2:
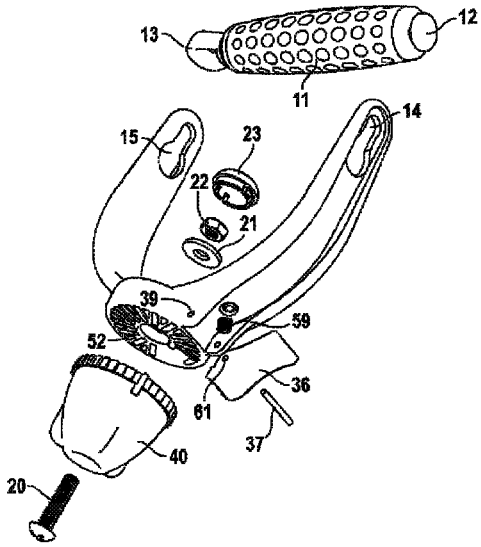
FIG. 2 is an exploded view of the universal handle device of FIG. 1.
Figure 5:
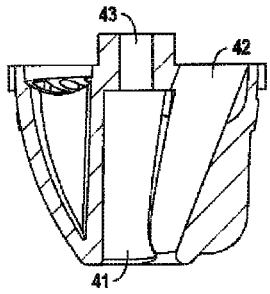
FIG. 5 is a cross section of the capture cap of FIG. 4 taken along line 5-5.

As noted in reference to FIG. 2, capture cap 40 is appended to yoke 16 by use of retention bolt 20 received by open end 41 and passage way 43 (FIG. 5). Bolt 20 is maintained in position by retention washer 21 and retention nut 22. Cap 23 completes the assembly enabling capture cap 40 to remain appended to yoke 15 in a rotatable relationship.

Turning once again to handle 11, it is noted that end 13 is in the form of a loop, the reason for which will become apparent in the disclosure which follows.

Figure 4:
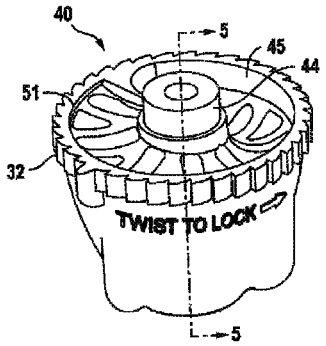
FIG. 4 is a perspective view of the capture cap of the present invention employed as an important part thereof.

As noted above, an essential structural component of the present invention is in the form of capture cap 40, the internal details of which can best be appreciated in reference to FIGS. 4 and 5. Capture cap 40 is received by yoke 16 at its mid-point having a circumferential edge 51 abutting yoke 16 at opening 52. Cord or flexible tube 24 enters opening 41 and is captured within helical passage 45 exiting capture cap 40 at opening 55 If capture cap 40 is then twisted in a counter-clock direction, helical passage 45 locks down cord on flexible tube 24 preventing it from release from device 10. As noted in reference to FIG. 5, passage 42 is in communication with opening 41 such that cord or flexible tube 24 passes within channel 42, again, to exit yoke 16 at opening 55.

As a safety measure and to prevent inadvertent release of cord or flexible tube 24 from device 10, capture cap 40 is provided with a series of indents 32 and a corresponding ratcheting safety release mechanism 36 which, when in a first orientation engages said series of indents 32 preventing capture cap 40 from rotating and thus maintaining cord or flexible tube 24 in locking engagement within helical channel 45. Ratchet safety capture and release mechanism 36 pivots about pin 37 biased by spring 59, and is maintained in place as pivot pin 37 passes within openings 29 of yoke 16 as well as through opening 61 of ratchet safety capture and release mechanism 36 as shown. When cord or flexible tube is to be released from device10, ratchet safety capture and release mechanism 36 is engaged by a thumb or finger of a user in applying pressure against spring 59 to remove its contact with series of indents 32 thus enabling capture cap to rotate in a clockwise direction enabling cord or flexible tube 24 to be released and removed from device 10 by pulling it away from capture cap 40.

As noted in reference to FIG. 1 the, longitunal axis of cord or flexible tube 24 is substantially perpendicular to the longitunal axis of handle 11, an orientation which is traditionally seen as that of a handle/cord combination. However, there are exercises and rehabilitative routines which would be more ideally carried out if cord or flexible tube 24 was to be oriented parallel to handle 11 as an alternative. In this regard, reference made to FIG. 3.

Figure 3:
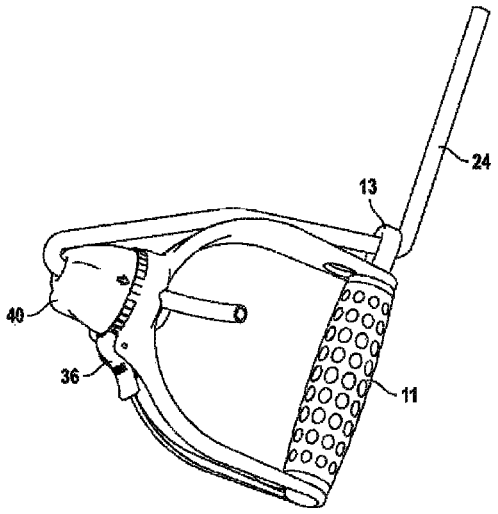
FIG. 3 is yet another perspective view of the universal handle device of the present invention with said cord or flexible tube being routed in an alternative orientation to that of FIG. 1

In turning to FIG. 3, cord or flexible tube 24, emanating from capture cap 40 is caused to pass through loop 13 in sliding engagement therewith. Thus, the longitunal axis of cord or flexible tube 24 is substantially parallel to the longitunal axis of handle 11 adding to the universal nature of the present invention.

In summary the present invention discloses for the first time a device which can interchangeably receive and releasable capture cords and flexible tubing of various resistances, thus obviating the need for multiple handles. In addition, this singular device is capable of routing the cord or flexible tube perpendicular or parallel to its gripping handle to again enhance its universality.

The above disclosure is sufficient to enable one of ordinary skill in the art to practice the invention, and provides the best mode of practicing the invention presently contemplated by the inventor. While there is provided herein a full and complete disclosure of the preferred embodiments of the invention, it is not desired to limit the invention to the exact construction, dimensions, relationships, or operations as described. Various modifications, alternative constructions changes and equivalents will readily occur to those skilled in the art and may be employed as suitable without departing from the true spirit and scope of the invention. Such changes might involved alternative materials, components, structural arrangements, sizes, shapes, forms, functions, operational features or the like. Therefore, the above description and illustration should not be considered as limiting the scope of the invention, which is defined by the appended claims.

What is claimed is:

1. A device for releasably retaining a cord or flexible tube, said device comprising a U-shaped yoke having terminal ends and a mid-point therebetween, an opening located proximate each of said terminal ends and a handle sized for gripping by the hand of a user, said handle having first and second ends, each of said first and second ends being sized for receipt by openings proximate each of said terminal ends of said U-shaped yoke and being rotatable therein, said handle further comprising a loop extending from one end thereof and sized to extend outside of said U-shaped yoke when said handle first and second ends are received by said openings, a capture cap having a capstan with a helical track supported at said mid-point of said yoke, said capture cap having a cap opening for receipt of said cord or flexible tube and a circumferential edge for abutting said yoke, said helical track being sized and positioned to receive said cord or flexible tube from said cap opening, said cord or flexible tube being lockably retained on said helical track upon rotation of said capture cap in a first direction and removable from said helical track upon rotation of said capture cap in a second direction.

2. The device of claim 1 wherein said loop is sized to facilitate passage of said cord or flexible tube therethrough.

3. The device of claim 1 wherein said capture cap further comprises a series of indents upon its circumferential edge.

4. The device of claim 3 further comprising a ratchet safety capture and release mechanism engaging said series of indents in which, in a first orientation, said capture cap is prevented from rotating with respect to said yoke and when in a second orientation, said capture cap is capable of rotating.

5. A device for releasably retaining a cord or flexible tube, said device comprising a U-shaped yoke having terminal ends and mid-points therebetween, an opening located proximate each of said terminal ends, a handle sized for gripping by a hand of the user, said handle having first and second ends, each of said first and second ends being sized for receipt by said opening proximate each of said terminal ends of said U-shaped yoke and being rotatable therein, said handle further comprising a loop extending from one end thereof and outside of said U-shaped yoke when said handle first and second ends are received by each of said openings, a capture cap having a capstan with a helical track supported at said mid-point of said U-shaped yoke said helical track sized to receive in lockable engagement, said cord or flexible tube, said capture cap having a cap opening for receipt of said cord or and flexible tube a circumferential edge for abutting said yoke, said cord or flexible tube being lockably retained on said helical track upon rotation of said capture cap in a first direction and removable from said helical track upon rotation of said capture cap in a second direction.

6. The device of claim 5 wherein said loop is sized to facilitate passage of said cord or flexible tube therethrough.

7. The device of claim 6 wherein said capture cap is further characterized as comprising a series of indents upon its circumferential edge.

8. The device of claim 7 further comprising a ratchet safety capture and release mechanism engaging said series of indents wherein in a first orientation, said capture cap is prevented from rotating with respect to said U-shaped yoke and when in a second orientation, and capture cap is capable of rotating.

* * * * *